United States Patent [19]

Wolters

[11] 3,994,152

[45] Nov. 30, 1976

[54] MACHINE FOR BENDING CLEAT EDGES

[76] Inventor: Oswald H. Wolters, Rte. 3, Sparta, Ill. 62286

[22] Filed: Feb. 19, 1976

[21] Appl. No.: 659,207

[52] U.S. Cl. ..... 72/315; 72/319

[51] Int. Cl.[2] ..... B21D 5/04; B21D 11/20

[58] Field of Search ..... 72/403, 315, 319, 388, 72/309, 384

[56] References Cited

UNITED STATES PATENTS

| | | | |
|---|---|---|---|
| 2,973,796 | 3/1961 | Engel et al. | 72/315 |
| 3,948,074 | 4/1976 | Stalzer | 72/312 |

*Primary Examiner*—Milton S. Mehr

*Attorney, Agent, or Firm*—Gravely, Lieder & Woodruff

[57] ABSTRACT

A cleat edge bending machine has an anvil provided with a free edge and two rotating wiper bars, the first of which is located directly beyond the free edge of the anvil, while the second is located below the anvil. The first bar has a gauging segment and a bending segment which follows the gauging segment insofar as the direction of rotation is concerned. The radius of the gauging segment increases toward the bending segment, and the bending segment has an abrupt increase in radius immediately beyond the gauging segment. A duct section on which a cleat edge is to be formed is placed upon the anvil and the bottom wall of the duct section is moved against the gauging segment on the first wiper bar. The bars are then rotated and as the first bar rotates, the duct section is forced backwardly, owing to the increase in radius of the gauging segment. The bending portion thereupon strikes the wall and bends its end 90° across the free edge of the anvil. Thereafter, the second wiper bar strikes the bent portion of the wall and bends it another 90°, creating a fully formed cleat edge at the end of the wall. Upon return of the bars to their rest position, the cleat edge is easily disengaged from the anvil and removed from the machine since the width of the cleat edge is less than the spacing between the free edge of the anvil and the gauging segment of the first bar.

12 Claims, 10 Drawing Figures

MACHINE FOR BENDING CLEAT EDGES

BACKGROUND OF THE INVENTION

This invention relates in general to machines for working sheet metal, and more particularly to an improvement to machines of the double bar variety which form reversely bent cleat edges on sheet metal.

The duct work in most residential, commercial, and industrial buildings is formed from sheet metal with each duct usually consisting of individual duct sections coupled together at their ends. To provide a coupling, the ends of adjacent duct sections are provided with reverse flanges which are more commonly referred to as cleat edges. Drive cleats are passed over the cleat edges and interlock with them to hold the duct sections together. More specifically, the flanges or cleat edges on the duct sections are bent backwardly at 180°, while the drive cleat has flanges which are turned inwardly at 180°. The flanges of the adjacent ducts and the flanges of the cleat interlock, thereby preventing the adjacent duct sections from pulling apart.

The cleat edges of the duct sections are normally machine formed, although they may be formed by hand operated tools. One machine for bending such cleat edges is disclosed in U.S. Pat. No. 2,973,796, issued Mar. 7, 1961.

The cleat edge forming machine of U.S. Pat. No. 2,973,796 is of the double wiper bar variety. Basically, it includes (FIGS. 1 and 2) a plate-like anvil, an upper wiper bar having its axis of rotation located directly beyond the end edge of the anvil and aligned therewith, and a lower wiper bar having its axis of rotation directly below the anvil. The duct section is placed on the anvil with the end of one of its walls projected beyond the end edge of the anvil. Then the wiper bars are revolved, and they rotate in unison, with the upper leading the lower insofar as contact with the duct wall is concerned. The timing and location of the wiper bars are such that the upper bar first strikes the outwardly projecting portion of the duct wall and turns downwardly at 90°. Then the lower wiper bar strikes the downwardly turned portion and turns it another 90°. Indeed, the end of the duct wall is turned a full 180° so that after the lower wiper bar passes beyond the turned portion, it is located beneath the anvil.

The upper wiper bar lies directly beyond the end of the anvil and is provided with a gauging segment, which when located opposite the edge of the anvil forms a stop against which the wall of the duct section may be brought (FIG. 1). This insures that a precisely measured portion of the duct wall will project beyond the anvil so that the cleat edge which is formed on the duct wall has the correct width.

The upper wiper bar has two rest positions. In the first (FIG. 1) the gauging segment is located directly beyond the end of the anvil so that projection of the duct wall is easily gauged. In the second (FIG. 2) the gauging portion is located away from the end edge of the anvil so that a greater distance exists between that end edge and the upper wiper bar. This enables the cleat edge to be disengaged from the anvil without being obstructed by the upper wiper bar.

At the completion of a bending cycle, the upper wiper bar is in its second rest position, that is, the one in which the greatest spacing exists between the first wiper bar and the anvil (FIG. 2). This enables the duct section to be easily disengaged and removed. However, before another duct wall may be bent, the upper wiper bar must be rotated to its first rest position, which is about 45° from the second, so that the gauging may be accomplished (FIG. 1). This constitutes an extra step in the operation and therefore consumes valuable time. Furthermore, it is not uncommon for an inattentive workman to forget the step altogether, in which case the projected portion of the duct wall is gauged against the wrong surface of the upper bar. Indeed, too much of the duct wall projects beyond the anvil. The excessive metal usually jams the machine and jams of this nature are often exceedingly difficult to clear. Sometimes, they necessitate partial disassembly of the machine.

SUMMARY OF THE INVENTION

One of the principal objects of the present invention is to provide a cleat edge forming machine of the double bar type with a gauging apparatus which is virtually incapable of producing jams. Another object is to provide a cleat edge forming machine of the type stated in which the wiper bars have only one rest position and in that position the duct wall may be gauged and also may be disengaged from the anvil, once the cleat edge is formed. A further object is to provide a machine of the type stated which is easy to operate and does not require experienced personnel. An additional object is to provide means for converting an existing cleat edge forming machine of the double bar variety such that it possesses the advantages of the present invention. These and other objects and advantages will become apparent hereinafter.

The present invention is embodied in a cleat edge forming machine including an anvil, bending means for bending sheet metal projected beyond the anvil, and gauging means forming a surface against which the sheet metal is positioned, the quaging means moving the sheet metal backwardly as the bending means approaches it. The invention also consists in the parts and in the arrangements and combinations of parts hereinafter described and claimed.

DESCRIPTION OF THE DRAWINGS

In the accompanying drawings which form part of the specification and wherein like numerals and letters refer to like pats wherever they occur.

DETAILED DESCRIPTION

Figure 1:
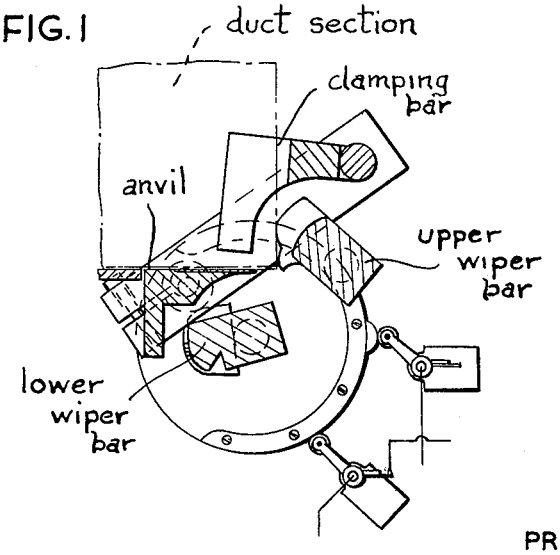
FIG. 1 is a sectional view of a conventional cleat edge forming machine with the wiper bars thereof being in one of their rest positions, that is, the rest position at which gauging is performed.

Referring now to the drawings (FIG. 3), A designates a cleat edge forming machine which accepts a duct section D and forms reverse flanges or cleat edges *a* (FIG. 4) at the ends of two of the four walls *b* on the duct section D. In so doing, the machine A turns the sheet metal of the end of the walls *b* a full 180°. In this regard, the conventional procedure for joining two duct sections D (FIG. 4) at their ends is to cut V-shaped notches into the walls *b* at their corners so that each wall *b* is provided with a longitudinal end segment or lip *c*. The lips *c* of two of the walls *b* are bent rearwardly 180° to form the cleat edges *a*, and the cleat edges *a* of the two duct sections D are brought into abutment, in which case the unbent lips *c* on the remaining two walls *b* will overlap. These unbent lips *c* overlap and are connected together with S-strips *d* which are, as their name implies, S-shaped in cross-section. The lip *c* of the one wall *b* is received in the one opening of the S configuration, while the lip *c* of the other wall *b* is received in the other opening of the S-configuration. When the S-strips are in place, a drive cleat *e* having inwardly turned 180° flanges is engaged at its end with two adjacent cleat edges *a* until the two cleat edges *a* are captured within the drive cleat *e* for their entire lengths. Thus, the drive cleat *e* interlocks with the cleat edges *a* and prevents the two duct sections D from pulling apart, while the S-strips *d* and the straight margins of the edges *c* prevent the duct sections D from moving together.

The cleat edge forming machine A includes a frame 2 (FIG. 3) which supports a horizontal work surface 3 and a fixed anvil 4 located at the end of the work surface 3. The upper surface of the anvil 4 is flush with the work surface 3. The anvil 4 terminates at a rearwardly presented free edge 6 (FIG. 5) which is perfectly straight. The anvil 4 is of uniform thickness and its major surface areas are unobstructed adjacent to the free edge 6.

Figure 5:
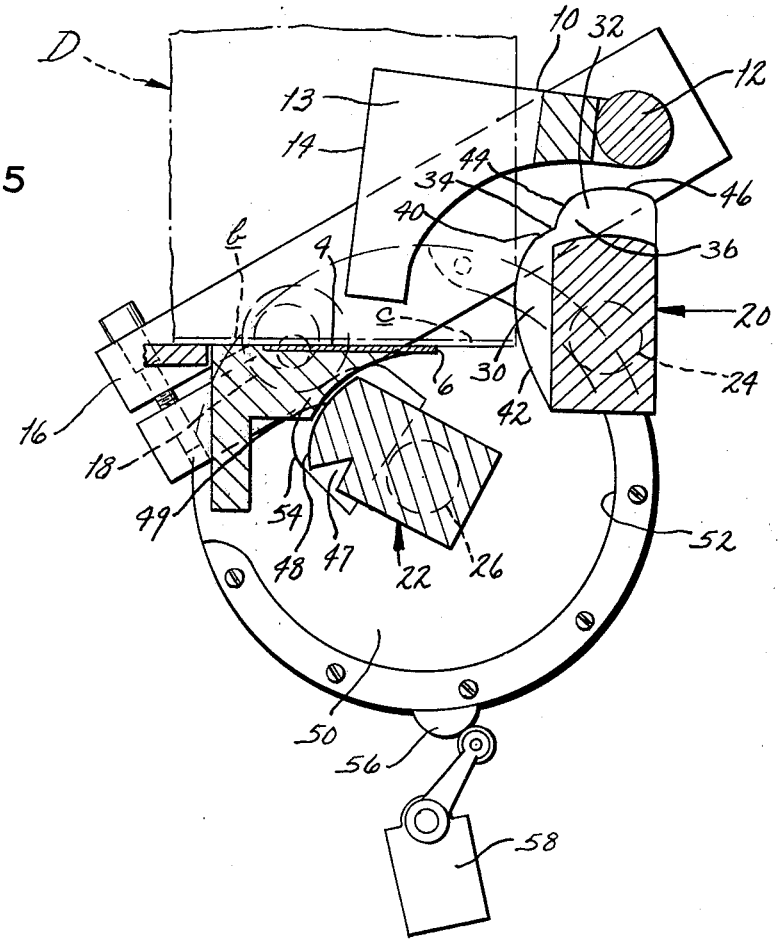
FIG. 5 is a sectional view of the cleat edge forming machine of the present invention with the wiper bars thereof in the rest position and the sheet metal moved against the gauging segment of the first bar.
Figure 6:
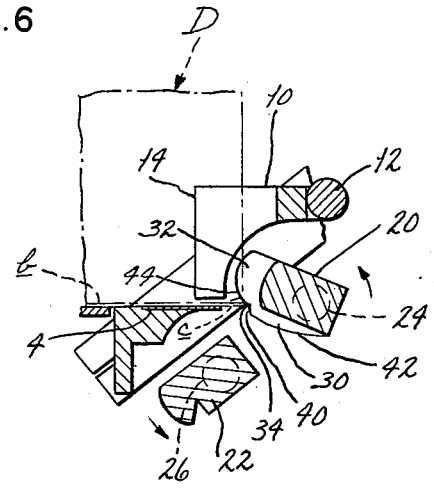
FIG. 6 is a sectional view similar to FIG. 5, but showing the bending portion of the first wiper bar engaging the metal projected beyond the anvil.
Figure 7:
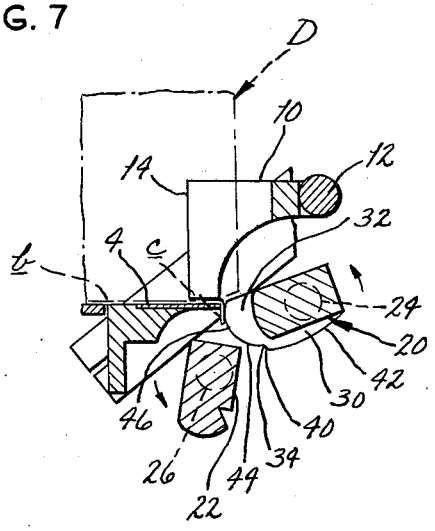
FIG. 7 is a sectional view similar to FIG. 6 and showing the first wiper bar turning the projecting portion of metal downwardly at 90°.
Figure 8:
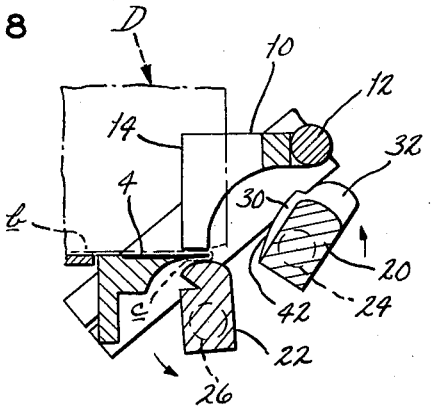
FIG. 8 is a sectional view similar to FIG. 7 and showing the second wiper bar turning the downwardly turned portion of metal backwardly to create the fully formed cleat edge.

In addition to the anvil 4, the frame 2 also supports a clamping bar 10 (FIGS. 3 & 5) which is attached to a pivot shaft 12 mounted on the frame 2 parallel to and generally above the free edge 6 of the anvil 4. The clamping bar 10 has cross slots 13 which are oriented perpendicular to the pivot shaft 12. The slots 13 divide the bar 10 into hold down fingers 14 which project outwardly over the anvil 4 and then downwardly toward the upper surface of the anvil 4. The lower surfaces of the fingers 14 are coplanar, and when the bar 10 is in its lowermost position those fingers 14 will bear against the upper surface of the anvil 4 (FIGS. 6–8). However, when pivot shaft 12 is rotated rearwardly, the fingers 14 are raised away from the anvil 4 (FIG. 5). This enables one wall *b* of a duct section D to be moved over the work surface 3 and anvil 4 to a position in which its lip *c* projects over the free edge 6. Thereafter, when the shaft 12 is rotated in the opposite direction, the bar 10 is lowered and its fingers 14 clamp the wall *b* of the duct section D tightly against the anvil 4. The shaft 12 has an actuating lever 16 attached to each of its ends, and these levers are provided with roller-type cam followers 10 (FIG. 5).

The lip *c* at the wall *b* which is against the work surface 3 and anvil 4 is bent into a cleat edge *a* by two wiper bars 20 and 22 which successively come against the lip *c*, each bending the lip *c* 90°. The bars 20 and 22 are mounted on shafts 24 and 26, respectively, which are received in bearings carried by the frame 2. The two shafts 24 and 26 are tied together through a gear train 27 (FIG. 3) which is powered by an electric motor 28 or some other device. The gear train 27 is such that the shafts 24 and 26 rotate in the same direction and velocity. In other words, the gear ratio between the two shafts is 1:1.

The first shaft 24 is positioned directly beyond the free edge 6 of the anvil 4 and generally below the pivot shaft 12 for the clamping bar 10 (FIG. 5). Indeed, the axis of the shaft 24 lies in the plane of the anvil 4, that is, the plane which passes through the center of the anvil 4 parallel to the major surface areas thereof. The wiper bar 20 projects radially from the shaft 24, yet is mounted rigidly on it. When the shaft 24 is rotated, the bar 20 after passing over the top center moves downwardly toward the upper surface of the anvil, and then passes by the free edge 6 of the anvil 4 in a generally horizontal disposition (FIGS. 6 & 7).

The first wiper bar 20 has a gauging segment 30 and a bending segment 32, both of which have curved external surfaces (FIG. 5). The gauging segment 30 precedes the bending segment 32 insofar as the direction of rotation is concerned, and where the segments 30 and 32 meet, the curved surface of the bending portion turns abruptly inwardly. This results in a well defined groove 34 in the wiper bar 20, that groove being parallel to the axes of rotation. Both segments 30 and 32 are provided with cross slots 36 which align with the slots 13 between the fingers 14 on the clamping bar 10. The slots 36 are deeper than the width of the lip *c*. Like the slots 13 on the clamping bar 10, the slots 36 on the wiper bar 20 accommodate the lips *c* on the vertical walls *b* of the duct section D so that the wiper bar 20 does not strike those lips *c* as it rotates.

The gauging segment 30 adjacent to the groove 34 has a surface portion 40 which is generally concentric to the axis of rotation and this portion exists for preferably about 10° (FIG. 10), although it may be between 0° and 25°. Ahead of the concentric portion 40 the gauging segment has a leading portion 42 of increasing radius. The portion 42 is preferably about 100° measured about the axis of rotation for the bar 20, but may be between 55° and 110°. Thus, the total arcuate length of the gauging segment 30 is preferably 110°. However, it may be between 55° and 135°. When the concentric portion 40 is located opposite the free edge 6 of the anvil 4, the spacing between the gauging segment 30 and the free edge 6 substantially equals the width of the cleat edge *a*. The leading portion 42 smoothly merges with the concentric portion 40, and insofar as the direction of rotation for the bar 20 is concerned the radius of the gauging segment 30 becomes progressively larger, with its largest radius being where it merges into the concentric portion 40. If the lip *c* on one wall *b* of the duct section D is brought against the leading portion 42 of the gauging segment 30 and the wiper bar 20 is rotated, the entire duct section D will be pushed backwardly over the work surface 3 due to the progressively larger radius of surface contacting the edge of the lip *c*. Of course, once the concentric portion 40, comes against the lip *c* (FIG. 6), the duct section D remains fixed in position or the work surface 3.

The surface on the bending segment 32 (FIG. 5) has a leading portion 44 which becomes progressively greater in radius away from the groove 34, and indeed the change of radius is quite abrupt, particularly at the groove 34. The leading portion 44 merges into a trailing portion 46 which is generally concentric to the axis of rotation for the shaft 24, and as the bar 20 rotates, this portion passes quite close to the free edge 6 of the anvil 4 (FIG. 7), the clearance being only slightly greater than the thickness of the sheet metal from which the duct section D is formed.

The second shaft 26 has its axis of rotation located directly beneath the anvil 4 slightly to the rear of the free edge 6 (FIG. ). The wiper bar 22, which is on the shaft 26, is very similar in configuration to the wiper bar 20. However, it does not have a gauging segment 30 or slots 36. Instead of a gauging segment 30, the second bar 22 is provided with a relatively deep notch 47 at the beginning of an abrupt portion 48 thereon. The abrupt portion 48 merges into a concentric trailing portion 49, and the trailing portion 49 on the bar 22 passes quite close the the underside of the anvil 4 (FIG. 8). Again, the clearance is slightly in excess of the thickness of the sheet metal from which the duct section D is formed.

Figure 10:
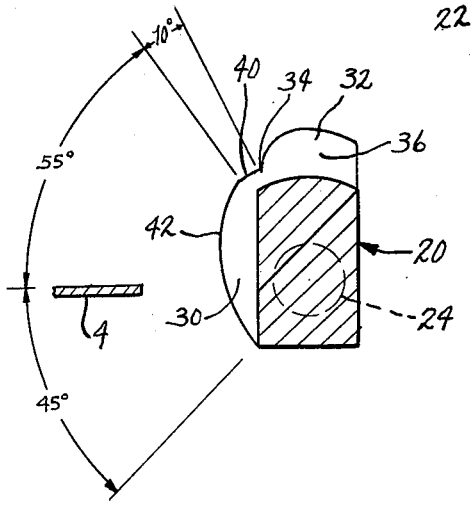
FIG. 10 is a sectional view showing the geometry of the first wiper bar when that bar is in its rest position.

When not in use, the two wiper bars 20 and 22 are in their rest positions and the clamping bar 10 is raised above the anvil (FIG. 5). In its rest position the first wiper bar 20 is about vertical or at top center. When the bar 20 is so disposed, the leading portion 42 on the gauging segment 30, that is the portion of increasing radius, is presented opposite the free edge 6 of the anvil 4, with about 55° being above the horizontal, that is above the anvil 4, and about 45° being below the horizontal (FIG. 10). The second wiper bar 22 is located about 30° above its horizontal position and projects forwardly away from the free edge 6 of the anvil 4.

The second shaft 26 is further provided with a disk 50 (FIG. 5) having a cam track 52 and a cam 54 thereon, both of which pass by and engage the cam follower 18 on the actuating lever 16. The cam 54 moves the lever 16 upwardly which in turn raises the clamping bar 10. The cam track 52, on the other hand, depresses the lever 16 and thereby urges the fingers 14 of the clamping bar 10 toward the anvil 4. Generally speaking, the cam 54 holds the clamping bar 10 upwardly when the wiper bars 20 and 22 are in their rest position, but during the remainder of the cycle the cam track 52 holds the bar 10 downwardly. The sequence in which the cam track 52 and cam 54 operate the lever 16 will be more apparent from the discussion of the operation.

The disk 50 is provided with still another cam 56 (FIG. 5) which operates a switch 58. When the bars 20 and 22 are in their rest positions, the cam 56 is opposite the switch 58 and the switch 58 is open. The switch 58 in turn is in the circuit to the motor 28. Thus, when the switch 58 is bypassed by another switch for starting (not shown), the motor 28 will be energized and will rotate the two bars 20 and 22. The disk 50 will likewise revolve and will move the cam 56 away from the switch 58, causing the switch to close. Thus, the motor 30 will remain energized and the bars 20 and 22 will continue to rotate. Indeed, the bars 20 and 22 will rotate until the cam 56 is again located opposite to the switch 58, in which case the switch 58 will open, stopping the motor 30. This requires one revolution of the disk 50 as well as the bars 20 and 22.

OPERATION

Figure 3:
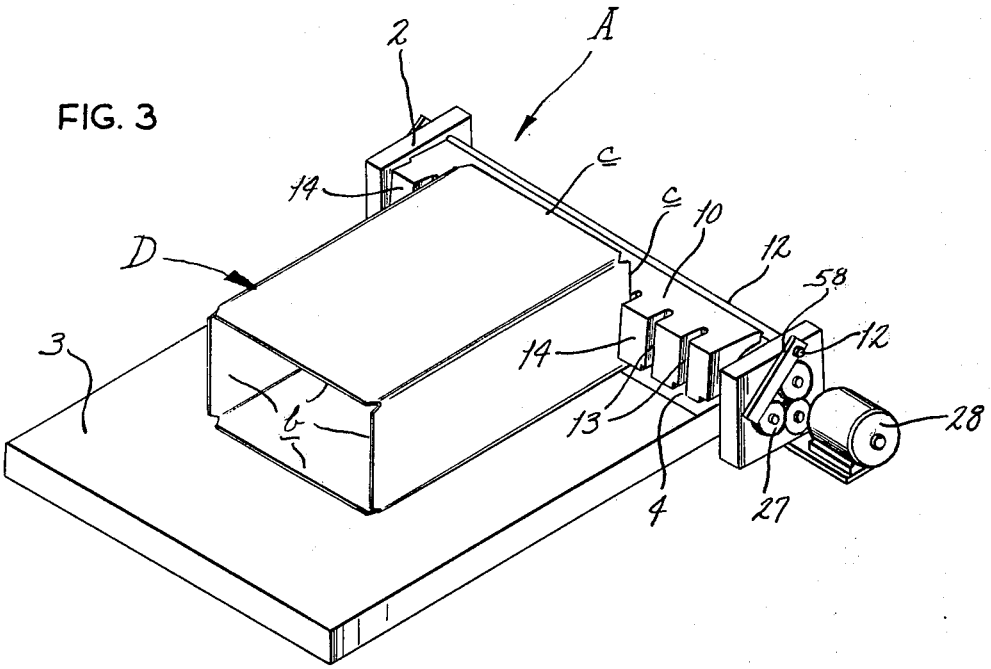
PRIOR ART FIG. 3
FIG. 3 is a perspective view of the cleat edge forming machine of the present invention.
Figure 4:
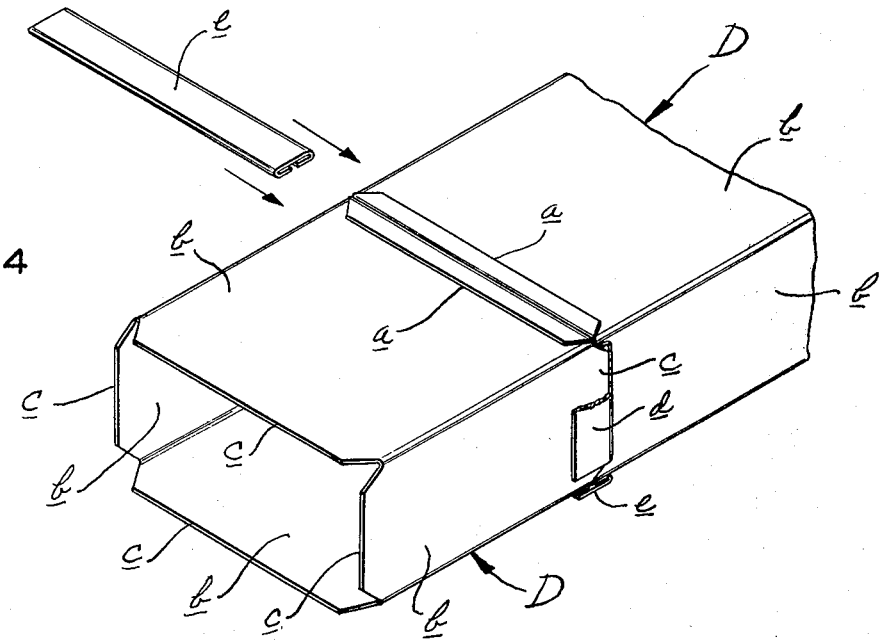
FIG. 4 is a perspective view of a typical duct showing the cleat edge on its individual duct sections and the drive cleat aligned with those cleat edges.

To create a cleat edge *a* on one of the walls *b* of the duct section D, the duct section D is placed on the horizontal work surface 3 of the machine A with that wall *b* against that work surface 3 (FIG. 3). The duct section D is then advanced toward the wiper bar 20 and is maneuvered such that its vertical walls *b* align with and pass into the slots 13 of the clamping bar 10, which is elevated. This enables the duct section D to be advanced over the work surface 3 and anvil 4 until the lip *c* on the bottom wall *b* comes against the gauging segment 30 of the wiper bar 20 (FIG. 5). When the duct section D is so disposed, the lip *c* is projected beyond the free edge 6 of the anvil 4 and the end edge of the lip *c* bears against the leading portion 42 on the gauging segment 30.

Once the duct section D is positioned with its lip *c* against the portion 42 of the gauging segment 30, the motor 28 is energized with the starting switch and it rotates the two wiper bars 20 and 22 in unison and at the same velocity. The first wiper bar 20 moves generally downwardly toward the anvil 4 and as it does, the leading portion 42 on the gauging segment 30 against which the lip *c* is positioned becomes progressively greater in radius, thus forcing the duct section D backwardly. When the concentric portion 40 of the gauging segment 30 comes against the lip *c* the rearward movement terminates. At this time, the cam 54 lowers the clamping bar 10. By the time the groove 34 reaches the lip *c* (FIG. 6), the cam track 52 has engaged the follower 18 on the lever 16 which in turn holds the clamping bar 10 downwardly, with the fingers 14 on the clamping bar 10 bearing down tightly against the wall *b* so as to hold the duct section D firmly in place on the work surface.

Continued rotation of the wiper bar 20 brings the leading portion 44 of the bending segment 32 into contact with the lip *c* (FIG. 6), and since this portion 44 possesses an abrupt change in radius, the lip *c* is driven downwardly across the free edge 6 of the anvil 4. Thereafter, the concentric portion 46 of the bending segment 32 wipes over the downwardly turned lip *c* (FIG. 7), and when that portion passes beyond the lip *c*, the lip *c* should be directed downwardly at about 90° with respect to the bottom wall *b*.

As the first wiper bar 20 moves upwardly after passing over the lip *c* (FIG. 8), the second wiper bar 22 moves upwardly and contacts the downwardly turned lip *c* at the leading portion 48 thereon, that is, the portion having the abrupt change in radius. Continued rotation of the second bar 22 drives the lip *c* rearwardly underneath the anvil 4 (FIG. 8), and as the concentric portion 49 of the bar 22 passes by the lip *c*, the lip *c* is turned a full 180° with respect to the remainder of the wall *b*, that is, it is disposed parallel to the anvil 4 and the remaining portion of the wall *b*.

Both wiper bars 20 and 22 move back to have their rest positions (FIG. 9), and when cam 56 operates the switch 58, the motor 30 is de-energized and the rotational movement terminates. During the final increment of the movement into the rest position, the cam follower 18 is released by cam track 52, and the pivot shaft 12 is rotated backwardly by the cam 54 so as to lift the clamping bar 10 away from the wall *b*. This releases the duct section D.

Figure 9:
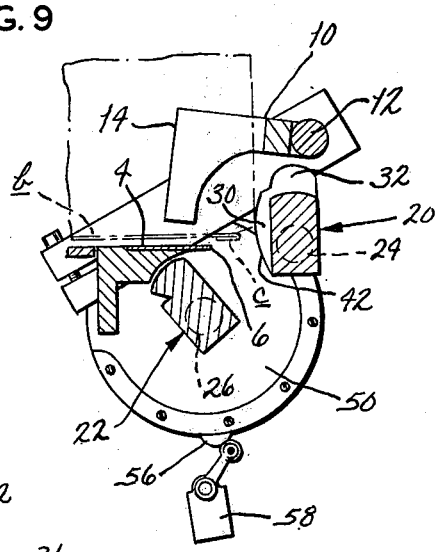
FIG. 9 is a sectional view similar to FIG. 8 and showing the wiper bars back in their rest position and the fully formed cleat edge being disengaged from the anvil of the machine.

To disengage the duct section D from the anvil 4, the duct section D is merely moved forwardly toward the wiper bar 20, and when the cleat edge *a* is beyond the free edge 6 of the anvil 4, the duct section D is lifted upwardly and withdrawn from the machine A (FIG. 9). The gauging segment 30 of the wiper bar 20 does not interfere with the withdrawal of the duct section D, inasmuch as the leading portion 42 thereof, that is the portion of increasing radius, is positioned opposite the leading edge. Thus, the spacing between the upper bar 20 and the free edge 6 of the anvil 4 is somewhat greater than the width of the cleat edge *a* so that adequate clearance exists to accommodate withdrawal of the cleat edge *a*. This would not be the case if the concentric portion 40 of the wiper bar 20 were located opposite the free edge 6 as is true of the machine disclosed in U.S. Pat. No. 2,973,796.

The presence of the gauging segment 30 on the wiper bar 20 enables the cleat edge *a* to be formed during a single uninterrupted rotation of the two wiper bars 20 and 22. In other words, once the wiper bars have come to rest, it is not necessary to reposition them in another gauging position prior to placing another duct section on the work surface 3. Not only does this eliminate the very real possibility of jamming the machine due to the failure to reposition the wiper bars, but it also considerably simplifies the electrical circuitry for the motor 28. In this connection, only one switch 58 is necessary instead of two as in the machine of U.S. Pat. No. 2,973,796.

Figure 2:
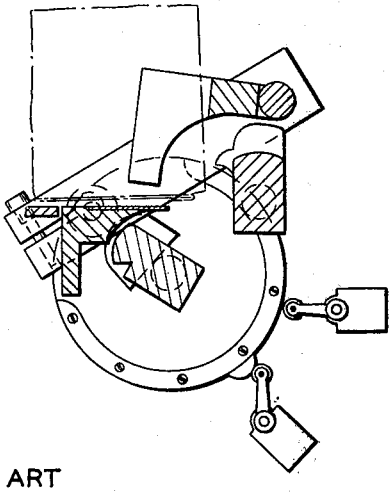
FIG. 2 is a sectional view showing the wiper bars of the conventional machine at the other of their rest positions, that is, the positions at which the fully formed cleat edge is disengaged from the anvil of the machine.

Conventional machines of the double wiper bar variety (FIGS. 1 & 2) may be easily modified to include the advantages of the present invention.

This invention is intended to cover all changes and modifications of the example of the invention herein chosen for purposes of the disclosure which do not constitute departures from the spirit and scope of the invention.

I claim:

1. A machine for forming a reversely bent cleat edge on sheet metal, said machine comprising: an anvil against which the sheet metal is positioned, the anvil having a free edge over which a portion of the sheet metal is projected; bending means for bearing against said portion of sheet metal across the free edge over which it projects, the bending means being movable with respect to the anvil, with the movement commencing at a rest position; and gauging means for providing a stop against which the sheet metal is located after being positioned against the anvil, the gauging means further causing the sheet metal to move backwardly as the bending means moves out of its rest position and prior to the actual bending of the sheet metal, so that the portion which is bent is of lesser width than the portion initially projected beyond the free edge of the anvil.

2. A machine according to claim 1 wherein the gauging means moves with the bending means.

3. A machine according to claim 2 wherein the gauging means is mounted on the bending means, whereby when the bending means returns to its rest position, sufficient clearance will exist between the gauging means and the free edge of the anvil to enable the reversely bent cleat edge to be disengaged from the anvil and withdrawn through the space between the gauging means and anvil.

4. A machine according to claim 3 wherein the bending means comprises a first wiper bar which rotates about an axis fixed in position with respect to the anvil.

5. A machine according to claim 4 wherein the first wiper bar has a bending segment thereon which engages said projecting portion of the sheet metal and bends it across the free edge of the anvil as the wiper bar rotates; and wherein the gauging means comprises a gauging segment preceding the bending segment on the wiper bar, the gauging segment being located opposite to the free edge of the anvil when the wiper bar is in its rest position, the radius of the gauging segment, measured from the axis of rotation for the wiper bar, being greater toward the bending segment.

6. A machine according to claim 5 wherein the wiper bar has a groove between the gauging segment and the bending segment, and the bending segment has an abrupt increase in radius immediately beyond the groove, said radius being measured from the axis of rotation for the bar.

7. A machine according to claim 5 wherein the gauging segment occupies between 55° and 135° measured about the axis of rotation for the bar.

8. A machine according to claim 5 wherein the bending segment commences between 55° and 80° beyond the location where said projecting portion of the sheet metal contacts the gauging segment when the wiper bar is at rest.

9. A machine according to claim 8 wherein the gauging segment is concentric to the axis of rotation for the wiper bar immediately prior to the bending segment.

10. A machine according to claim 5 wherein the first wiper bar bends said projecting portion of sheet metal about 90° across the free edge of the anvil, and wherein the bending means further comprises a second wiper bar which bends said projecting portion about another 90°.

11. A machine for forming a reversely bent cleat edge on sheet metal, said machine comprising: a frame; an anvil on the frame and having a free edge; a first wiper bar mounted for rotation on the frame about an axis located generally beyond the free edge of the anvil, the first wiper bar commencing its rotation from a rest position and returning to the rest position upon completion of the rotation, the first wiper bar having a gauging segment and a bending segment following the gauging segment, the gauging segment being of progressively larger radius with respect to the direction of rotation so that the sheet metal which is brought against the gauging segment when the bar is at rest will thereafter be forced backwardly over the anvil as the wiper bar rotates, the bending segment being configured to engage the portion of the sheet metal projected beyond the free edge of the anvil and to bend that portion across the free edge as the wiper bar rotates; and a second wiper bar mounted on the frame for rotation about an axis parallel to the axis of the first bar, the second bar being configured and located to subsequently engage the portion of sheet metal bent by the first bar and to bend that portion still further such that it is behind the anvil and the reversely bent cleat edge is fully formed about the anvil, whereby when the first bar returns to its rest position, the spacing between it and the free edge of the anvil will be greater than the width of the cleat edge so the cleat edge may be easily disengaged from the anvil and withdrawn from the machine.

12. A machine according to claim 11 wherein the first bar has a groove between the gauging and bending segments.

* * * * *

UNITED STATES PATENT OFFICE

CERTIFICATE OF CORRECTION

Patent No. 3,994,152 Dated November 30, 1976

Inventor(s) Oswald H. Wolters

It is certified that error appears in the above-identified patent and that said Letters Patent are hereby corrected as shown below:

Column 3, line 38, after "cleat edges a" and before "until", the following should be inserted "and is advanced longitudinally along the cleat edges a".

Column 4, line 8, change "10" to "18".

Column 7, line 48, (Claim 1), after "metal" and before "across", the following should be inserted "and bending said portion".

Signed and Sealed this

Eighth Day of February 1977

[SEAL]

*Attest:*

RUTH C. MASON
*Attesting Officer*

C. MARSHALL DANN
*Commissioner of Patents and Trademarks*